US010144111B2

(12) United States Patent
Gasparino, Jr.

(10) Patent No.: US 10,144,111 B2
(45) Date of Patent: Dec. 4, 2018

(54) BENCH GRINDER SAFETY AND MONITORING SYSTEM

(71) Applicant: Joseph Peter Gasparino, Jr., Granger, IN (US)

(72) Inventor: Joseph Peter Gasparino, Jr., Granger, IN (US)

( * ) Notice: Subject to any disclaimer, the term of this patent is extended or adjusted under 35 U.S.C. 154(b) by 295 days.

(21) Appl. No.: 15/147,134

(22) Filed: May 5, 2016

(65) Prior Publication Data

US 2017/0320191 A1 Nov. 9, 2017

(51) Int. Cl.

| | |
|---|---|
| ***B24B 55/00*** | (2006.01) |
| ***B24B 27/02*** | (2006.01) |
| ***B24B 49/12*** | (2006.01) |
| ***B24B 49/18*** | (2006.01) |

(52) U.S. Cl.

CPC ..... *B24B 55/00* (2013.01); *B24B 27/02* (2013.01); *B24B 49/12* (2013.01); *B24B 49/183* (2013.01)

(58) Field of Classification Search

CPC ..... B24B 27/02; B24B 49/12; B24B 49/183; B24B 55/00

USPC ..... 451/6, 11, 21, 349, 406

See application file for complete search history.

(56) References Cited

U.S. PATENT DOCUMENTS

| | | | | |
|---|---|---|---|---|
| 1,032,686 | A * | 7/1912 | Kundig | B24B 49/18 451/22 |
| 2,770,798 | A | 11/1956 | Roth | |
| 3,250,043 | A * | 5/1966 | Finkl | B24B 47/18 451/10 |
| 3,782,046 | A * | 1/1974 | Schaap | B24B 41/06 125/11.03 |
| 4,020,601 | A * | 5/1977 | Gray | B24B 41/06 451/21 |
| 4,524,547 | A | 6/1985 | Heaston et al. | |
| 4,679,358 | A * | 7/1987 | Sieradzki | B61K 9/12 451/21 |
| 5,184,428 | A | 2/1993 | Feldt et al. | |
| 5,525,095 | A | 6/1996 | Baughman | |
| 5,533,931 | A | 7/1996 | Imai et al. | |
| 5,741,172 | A | 4/1998 | Trionfetti et al. | |
| 6,602,109 | B1 | 8/2003 | Malkin et al. | |
| 6,985,791 | B2 | 1/2006 | Malkin et al. | |
| 9,114,502 | B2 * | 8/2015 | Brooks | B24B 27/02 |
| 2003/0194946 | A1 | 10/2003 | Malkin et al. | |
| 2004/0266318 | A1 * | 12/2004 | Doman | B24B 3/36 451/5 |

(Continued)

*Primary Examiner* — Eileen Morgan
(74) *Attorney, Agent, or Firm* — Dale J. Ream

(57) ABSTRACT

A bench grinder safety and monitoring system for maintaining worker safety while using a bench grinder having a contactor wheel, a tool rest proximate the contactor wheel defining a tool rest gap and having a tongue guard proximate the contactor wheel defining a tongue guard gap. The system includes a first optical sensor situated within in the tool rest gap having an emitter portion coupled to the tool rest adjacent a first side of the contactor wheel and a receiver portion coupled to the tool rest adjacent a second side of the contactor wheel, the emitter portion configured to project a beam of light across the tool rest gap toward the receiver portion. A controller in data communication with the receiver portion of the first optical sensor, is configured to determine if the light beam is received by the receiver portion and, if so, to de-energize the motor.

21 Claims, 7 Drawing Sheets

(56) References Cited

U.S. PATENT DOCUMENTS

2014/0030968 A1* 1/2014 Brooks ..... B24B 41/06
451/406

* cited by examiner

BENCH GRINDER SAFETY AND MONITORING SYSTEM

BACKGROUND OF THE INVENTION

This invention relates generally to bench grinder equipment and, more particularly, to a bench grinder safety and monitoring system that continuously monitors the gap between a tool rest or tongue guard and the front surface of a grinder contactor wheel and that de-energizes the contactor wheel if a respective gap becomes larger than a predetermined safe distance.

A bench grinder is a bench top grinding apparatus having one or more abrasive wheels (also referred to as "contactor wheels") that operate to cut or machine the surface of a work piece when pressed against the abrasive wheel. The bench grinder may have one or more tool rests having the primary functionality of providing a surface for a work piece to rest on during use of the grinder. Also, the tool rest is situated about ⅛" from the front surface of the abrasive wheel and provides safety against the work piece falling between the tool rest and the wheel and to prevent a user's fingers from becoming pinched therebetween. The bench grinder may also include a tongue guard upwardly displaced from the tool rest that provides similar protection of a user's fingers.

Unfortunately, the gap between a tool rest or tongue guard and the front surface of the abrasive wheel naturally becomes larger as the abrasive wheel wears away during use. This results in a dangerous condition that may result in injury. Further, a gap larger than a certain distance may be a violation of OSHA regulations and result in fines and loss of productivity.

Therefore, it would be desirable to have a safety and monitoring system in use with a bench grinder that constantly monitors the gap between a tool rest or tongue guard and the front surface of a contactor wheel. Further, it would be desirable to have a safety and monitoring system that de-energizes the contactor wheel if a respective gap is detected as being larger than a safe distance. In addition, it would be desirable to have a safety and monitoring system that prohibits re-energizing the contactor wheel following a power outage until an activation member is proactively and manually actuated by a user.

SUMMARY OF THE INVENTION

A bench grinder safety and monitoring system according to the present invention for maintaining worker safety while using a bench grinder having a motor operatively coupled to a contactor wheel, a tool rest in lower proximity to the contactor wheel that defines a tool rest gap between the tool rest and contactor wheel and having a tongue guard in upper proximity to the contactor wheel that defines a tongue guard gap. The safety and monitoring system includes a first optical sensor situated within in the tool rest gap having an emitter portion coupled to the tool rest adjacent a first side of the contactor wheel and a receiver portion coupled to the tool rest adjacent a second side of the contactor wheel, the emitter portion configured to project a beam of light across the tool rest gap toward the receiver portion. A controller is electrically connected to the motor of the bench grinder and in data communication with the receiver portion of the first optical sensor, the controller configured to determine if the light beam is received by the receiver portion and, if so, to de-energize the motor.

Similarly, the safety and monitoring system includes a second optical sensor situated within in the tongue guard gap having an emitter portion coupled to the tool rest adjacent the first side of the contactor wheel and a receiver portion coupled to the tongue guard adjacent the second side of the contactor wheel, the emitter portion configured to project a beam of light across the tongue guard gap toward the receiver portion. The controller is in data communication with the receiver portion of the second optical sensor and configured to determine if the light beam is received by the receiver portion and, if so, to de-energize the motor.

Therefore, a general object of this invention is to provide a bench grinder safety and monitoring system for maintaining worker safety while using a bench grinder.

Another object of this invention is to provide a bench grinder safety and monitoring system having sensors that constantly monitor the gap between a tool rest and the front surface of a contactor wheel.

Still another object of this invention is to provide a bench grinder safety and monitoring system having sensors that constantly monitor the gap between a tongue guard and the front surface of a contactor wheel.

Yet another object of this invention is to provide a bench grinder safety and monitoring system that de-energizes the contactor wheel when a safety gap is detected as exceeding a safe distance.

A further object of this invention is to provide a bench grinder safety and monitoring system having a digital display that publishes current gap size readings and other safety instructions.

A still further object of this invention is to provide a bench grinder safety and monitoring system that only re-energizes the contactor wheel when power is restored following an outage if a on-off activation member is manually actuated.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
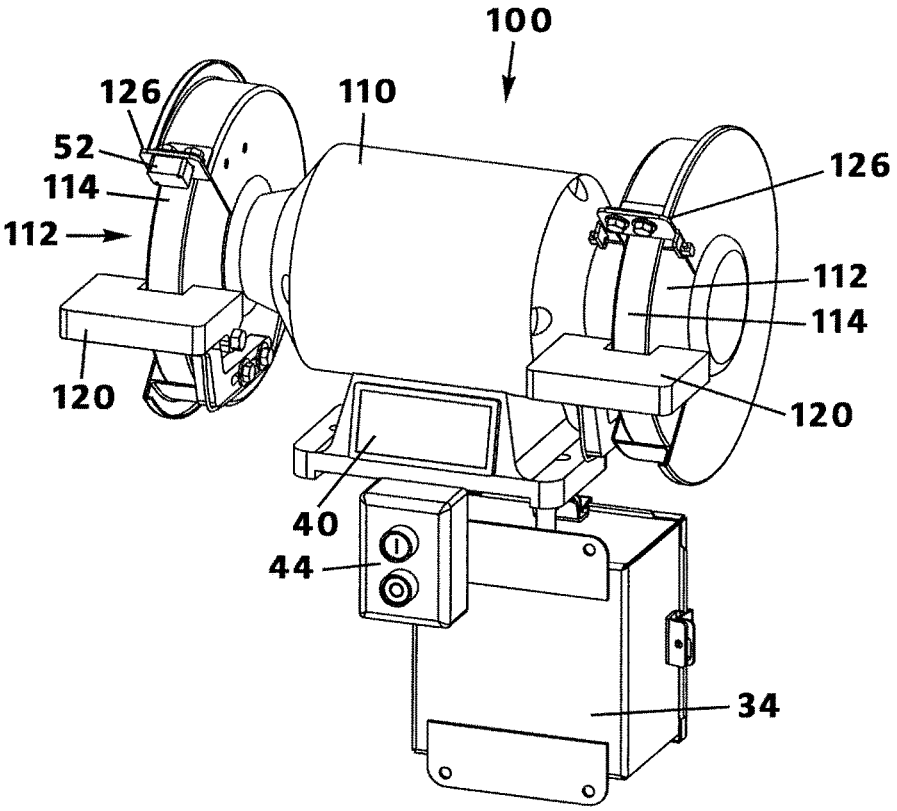
FIG. 1*a* is a front perspective view of a bench grinder safety and monitoring system according to a preferred embodiment of the present invention in use with a bench grinder.
Figure 1B:
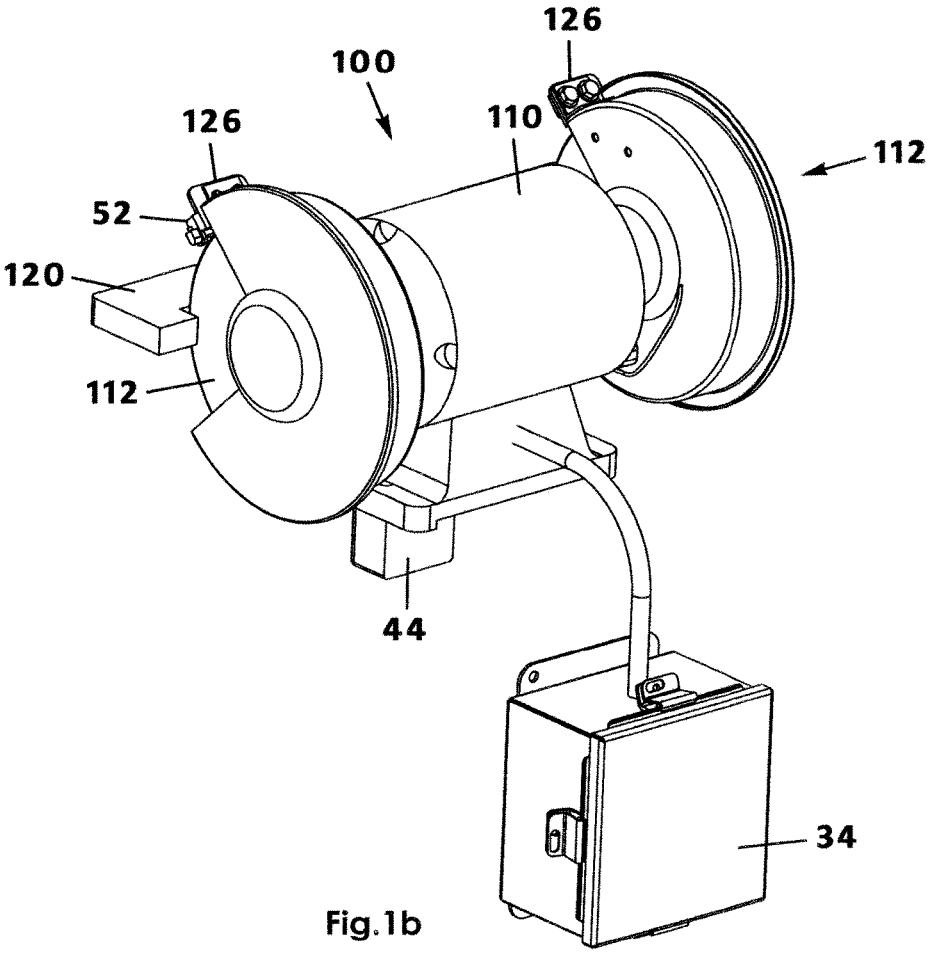
FIG. 1*b* is a rear perspective view of the bench grinder safety and monitoring system as in FIG. 1*a;*
Figure 2A:
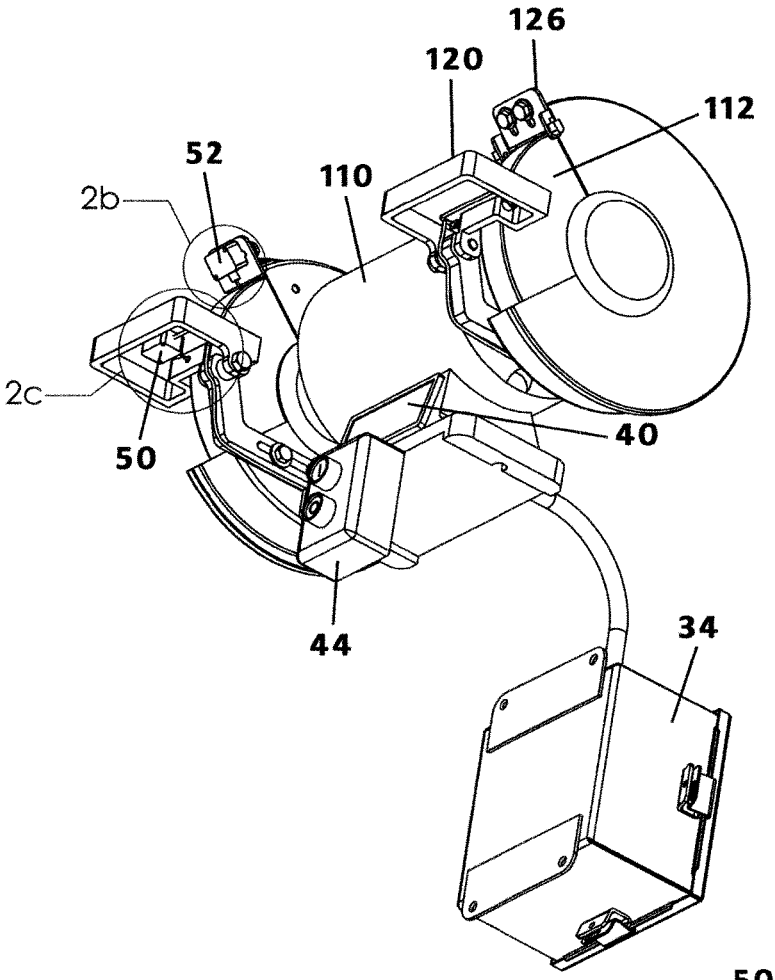
FIG. 2*a* is a perspective view from a lower angle of the bench grinder safety and monitoring system as in FIG. 1*a;*
Figure 2B:
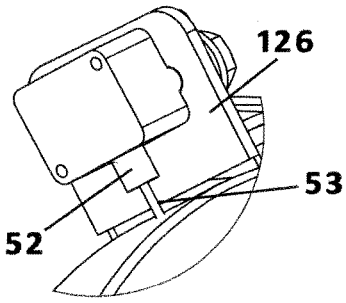
FIG. 2*b* is an isolated view on an enlarged scale taken from FIG. 2*a;*
Figure 2C:
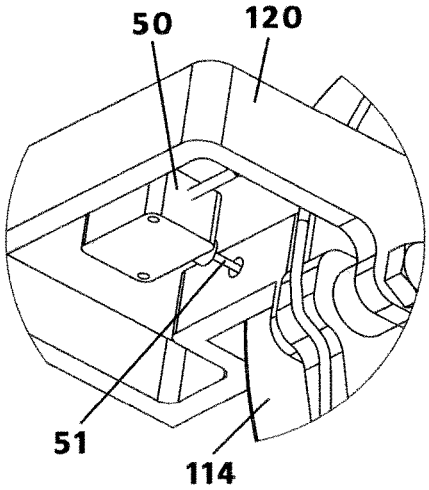
FIG. 2*c* is an isolated view on an enlarged scale taken from FIG. 2*a;*
Figure 3A:
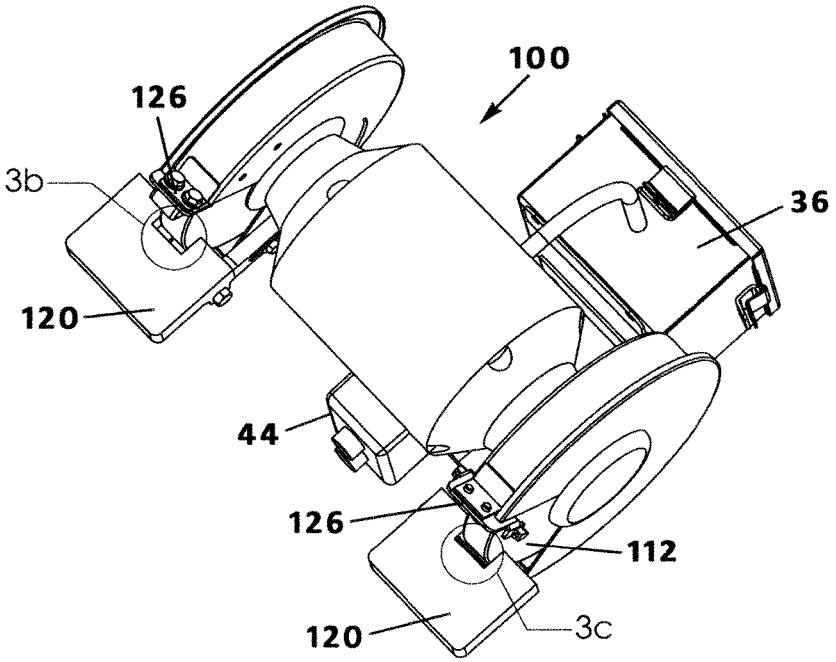
FIG. 3*a* is a top perspective view of the bench grinder safety and monitoring system as in FIG. 1*a;*
Figure 3B:
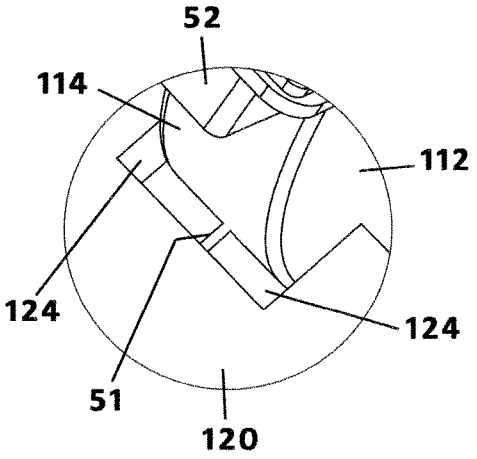
FIG. 3*b* is an isolated view on an enlarged scale taken from FIG. 3*a;*
Figure 3C:
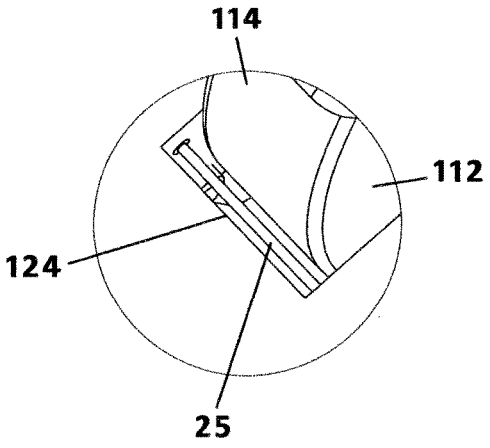
FIG. 3*c* is an isolated view on an enlarged scale taken from FIG. 3*a;*
Figure 4A:
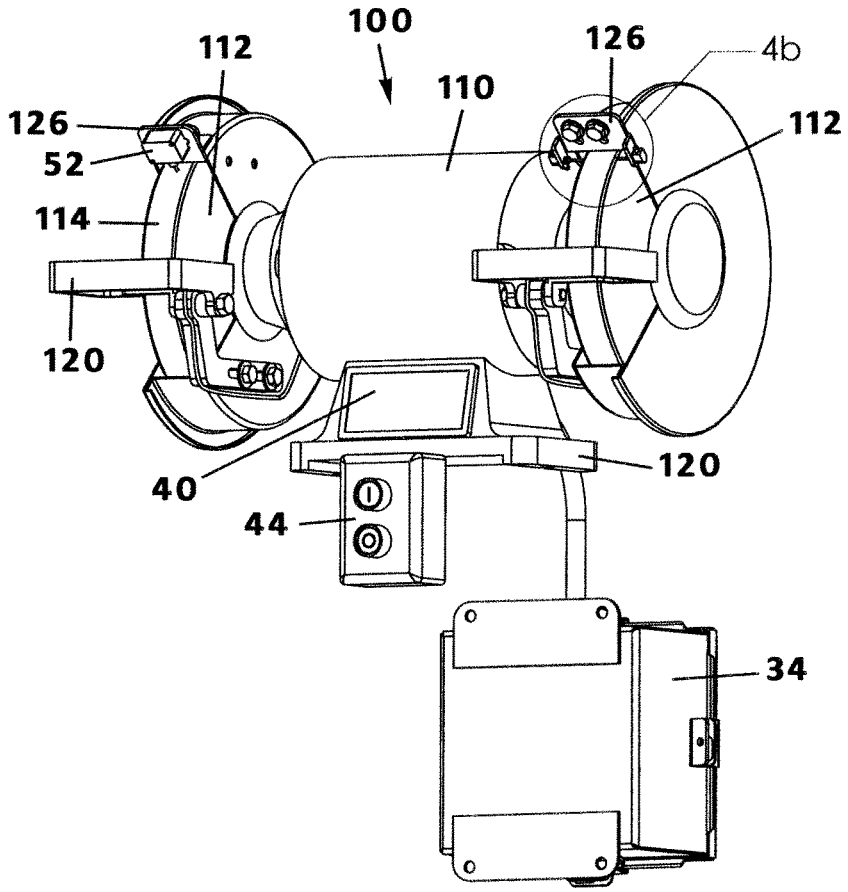
FIG. 4*a* is another perspective view of the bench grinder safety and monitoring system as in FIG. 1*a;*
Figure 4B:
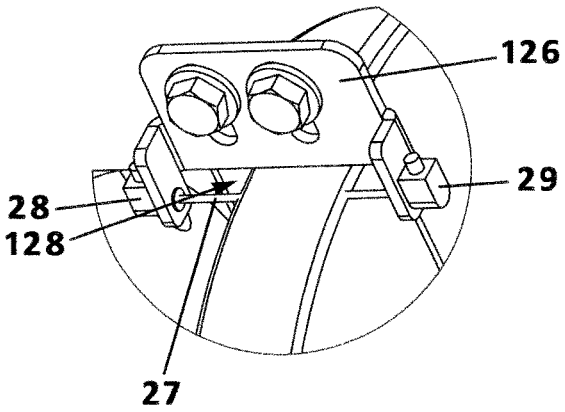
FIG. 4*b* is an isolated view on an enlarged scale taken from FIG. 4*a;*
Figure 5:
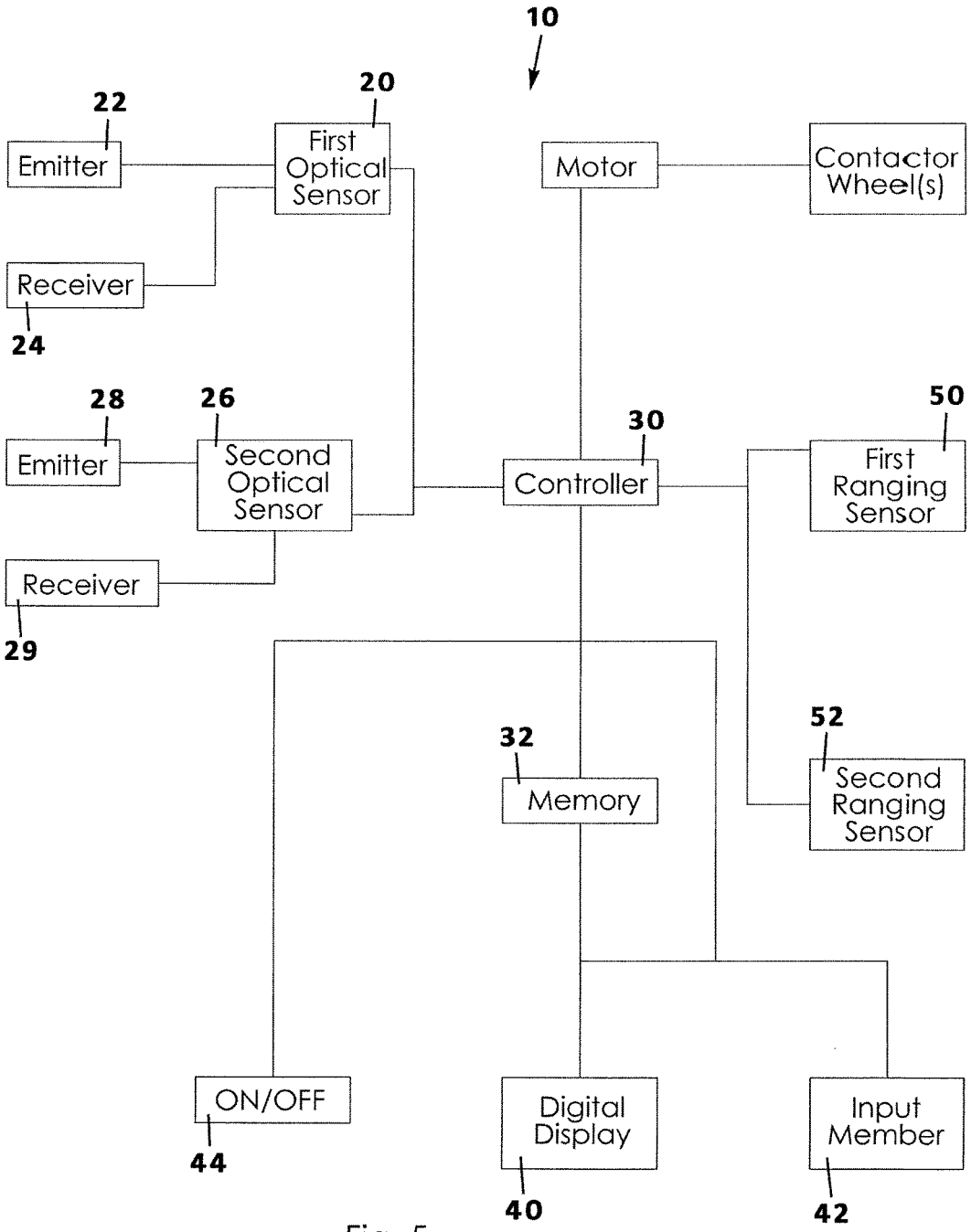
FIG. 5 is a block diagram of the electronic components of the safety and monitoring system.

A bench grinder safety and monitoring system according to a preferred embodiment of the present invention will now be described with reference to FIGS. 1 to 6 of the accompanying drawings. The bench grinder safety and monitoring system 10 includes a first optical sensor 20, a second optical sensor 26, and a controller 30 configured to determine if a gap between the tool rest 120 or tongue guard 126 has become too large and, thus, unsafe to a worker using the bench grinder 100. Other optical and range sensors may also be included in the bench grinder safety and monitoring system 10 as described below.

According to the present invention, the bench grinder safety and monitoring system 10 is configured for use with a bench grinder 100 of the type having a motor 110 electrically connected to a disc-shaped contactor wheel 112 (also referred to as an abrasive wheel) and configured to spin the wheel at a high rate of speed when electrically energized, such as with traditional A/C power. Preferably, the contactor wheel 112 is positioned within a vertical plane and has a front contactor surface 114 (or front edge) against which a work piece may be pressed against by a worker, whereby to grind the surface of the work piece.

The bench grinder 100 may include a tool rest 120 situated in lower proximity to the contactor wheel 112 on which the work piece may be rested or that just provides stability in use. The tool rest 120 may include portions that appear to wrap around or envelope the front contactor surface 114 (FIG. 1*a*), the tool rest 120 defining a tool rest gap 124 between the tool rest 120 and the contactor wheel 112. This gap is intentionally small so as to minimize the risk that a user's fingers, clothing, or the work piece itself will become pinched between the tool rest 120 and contactor wheel 112 and, as a result, cause physical injury.

Similarly, a bench grinder 100 may also include a tongue guard 126 situated in upper proximity to the contactor wheel 112. The tongue guard 126 may include portions that appear to wrap around or envelope the front contactor surface 114 (FIG. 1*a*), the tongue guard 126 defining a tool guard gap 128 between the tongue guard 126 and the contactor wheel 112. Again, the gap is preferably small so as to minimize the risk that a worker's fingers or clothing will come into inadvertent contact with the contactor wheel 112. The distance between the tool rest 120 or tongue guard and the contactor wheel 112 may be a "predetermined distance" as determined by the original equipment manufacturer (OEM) or by government regulation. It is understood that as the front contactor surface 114 wears down as a result of grinding operations, the respective gap becomes larger and, at some point, becomes unacceptably and dangerously large.

It is understood that a bench grinder 100 may include more than one contactor wheel 112 and, correspondingly, more than one tool rest 120 and tongue guard 126. For instance, the bench grinder 100 may include a pair of spaced apart contactor wheels 112 that rotate in respective vertical planes on either side of a common motor 110. This "dual" type bench grinder 100 may also include a pair of tool rests 120 positioned in lower proximity to respective contactor wheel 112 and a pair of tongue guards 126 in upper proximity to respective contactor wheels 112. Both contactor wheels 112 are electrically connected to the motor 110 and the controller 30 for operation as will be explained in more detail below. All like components, however, will be labeled herein using the same reference numerals. The pair of contactor wheels may be referred to later as a first contactor wheel and a second contactor wheel. It is understood, of course, that a bench grinder 100 may be manufactured with or integrated with the bench grinder safety and monitoring system 10 although such a bench grinder 100 may be retrofitted with the bench grinder safety and monitoring system 10, as described below.

A first optical sensor 20 may be situated within the tool rest gap 124 and configured to monitor if the gap is within the predetermined size/distance or has become too large (such as greater than ⅛") and, as a result, too dangerous. More particularly, the first optical sensor 20 includes an emitter portion 22 coupled to the tool rest 120 adjacent a first side of the contactor wheel 112 and a receiver portion 24 coupled to the tool rest 120 adjacent a second side of the contactor wheel 112. The emitter portion 22 of the first optical sensor 20 is configured to emit a light beam 25 across the tool rest gap 124 toward the receiver portion 24. The light beam 25 is projected in a linear path parallel with the longitudinal extent of the tool rest gap 124 and perpendicular to the plane defined by the front contactor surface 114.

Similarly, a second optical sensor 26 may be situated within the tongue guard gap 128 and configured to monitor if the gap is within the predetermined size/distance or has become too large. More particularly, the second optical sensor 26 includes an emitter portion 28 coupled to the tongue guard 126 adjacent a first side of the contactor wheel 112 and a receiver portion 29 coupled to the tool rest 120 adjacent a second side of the contactor wheel 112. The emitter portion 28 of the second optical sensor 26 is configured to emit a light beam 27 across the tongue guard gap 128 toward the receiver portion 29. As with the first optical sensor 20, the light beam 27 projected by the second optical sensor 26 is parallel with the longitudinal extent of the tongue guard gap 128 and perpendicular to the plane defined by the front contactor surface 114.

The safety and monitoring system 10 includes a controller 30 electrically connected to the motor 110 of the bench grinder 100 and is in data communication with the optical sensors—particularly to the receiver portions thereof. The controller 30 is configured to determine if respective light beams are received by respective receiver portions. The controller 30 is configured to interpret that so long as the beam is not received by a respective receiver portion, the tool rest gap 124 or the tongue rest gap 124 is less than a predetermined distance and operation of the conductor wheel 112 may continue. However, the controller 30 is configured to interpret that if the light beam is received by a respective receiver portion, then the gap is greater than the predetermined distance (such as about ⅛") and that electricity to the motor 110 must be interrupted. Stated another way, the controller 30 is configured to de-energize the motor 110 if the light beam has reached a respective receiver portion. It is understood that the controller 30 is configured to de-energize the motor 110 in the same manner whether it is the tool rest gap 124 or the tongue rest gap 124 that has become too large.

It is understood that the controller 30 may include circuitry, wires, or a processor controlled by programming. The controller 30 may include a non-volatile memory 32 configured to store programming instructions and data, such as the predetermined distance associated with an acceptable versus unacceptable gap, as described above. The controller 30 and other electronic or electricity related components may be situated in a control box 34.

Further, the bench grinder safety and monitoring system 10 may include a digital display 40 that may be mounted to the framework of a bench grinder 100. The digital display 40 is in data communication with the controller 30 and configured to publish (i.e. display) sensor data with regard to the first and second optical sensors. For instance, the controller 30 is configured to actuate the digital display 40 to display data indicative of whether light beams of either the first optical sensor 20 or second optical sensor 26 are broken (i.e. gap is ok) or are continuous between respective emitters and receivers (i.e. gap is too large and motor 110 is de-energized).

In an embodiment, the digital display 40 may include an input member 42 so that a user is enabled to enter data to be used by the controller 30. Specifically, the digital display 40 may include a touch screen input member in which a user may input or edit the predetermined distance parameter.

An activation member 44 may be electrically connected to the controller 30 and configured to selectively energize or de-energize the motor 110 to operate the one or more contactor wheels 112. The activation member 44 may be a housing mounted to the bench grinder 100 having prominent on and off buttons. The activation member 44 is connected first to the controller 30 because the controller 30 is configured to prevent A/C electrical power to the motor 110 even after electrical power may be restored following a power outage. For instance, a motor 110 that is de-energized due to a power outage, such as to a common house fan, is automatically re-energized when power is restored. By contrast, a safety feature of the bench grinder safety and monitoring system 10 is that the motor 110 of a bench grinder 100 is not re-energized automatically when power is restored but, rather, requires user-actuation of the activation member 44 to re-activate the motor 110.

The bench grinder safety and monitoring system 10 may also include ranging sensors for determining an unacceptable tool rest or tongue guard gap. The ranging sensors may be situated for use with one or both of the contactor wheels, tool rests, and tongue guards of the bench grinder 100 and may be used in combination with an optical sensor. Now, more particularly, a first ranging sensor 50 may be coupled to the tool rest 120 and configured (i.e. aimed) to reflect a light beam 51 directly toward the front contactor surface 114 of a respective contactor wheel 112 such that a reflected beam 51 is received that is indicative of a distance between the tool rest 120 and the contractor wheel 112.

Similarly, a second ranging sensor 52 may be coupled to the tongue guard 126 and configured (i.e. aimed) to reflect a light beam directly toward the front contactor surface 114 of a respective contactor wheel 112 such that a reflected beam is received that is indicative of a distance between the tongue guard 126 and the contractor wheel 112. Then, the controller 30 is configured (via wires, circuitry, or a processor executing programming instructions) to determine if the distance indicated by a respective reflected beam 53 is less than a predetermined distance. If so, the controller 30 is configured to de-energize the contactor wheel 112, i.e. to block or interrupt the flow of current to the motor 110.

When one or more ranging sensors are utilized, it is even more advantageous to have the input member 42 in data communication with the digital display 40 and controller 30. Specifically, a user may then enter or edit the predetermined distance to be monitored relative to a tool rest or tongue guard gap. Then, the controller 30 is able to compare an actual distance determined by a respective ranging sensor to the predetermined distance and, to de-energize the motor 110 if the actual distance becomes larger than the predetermined distance.

Figure 6:
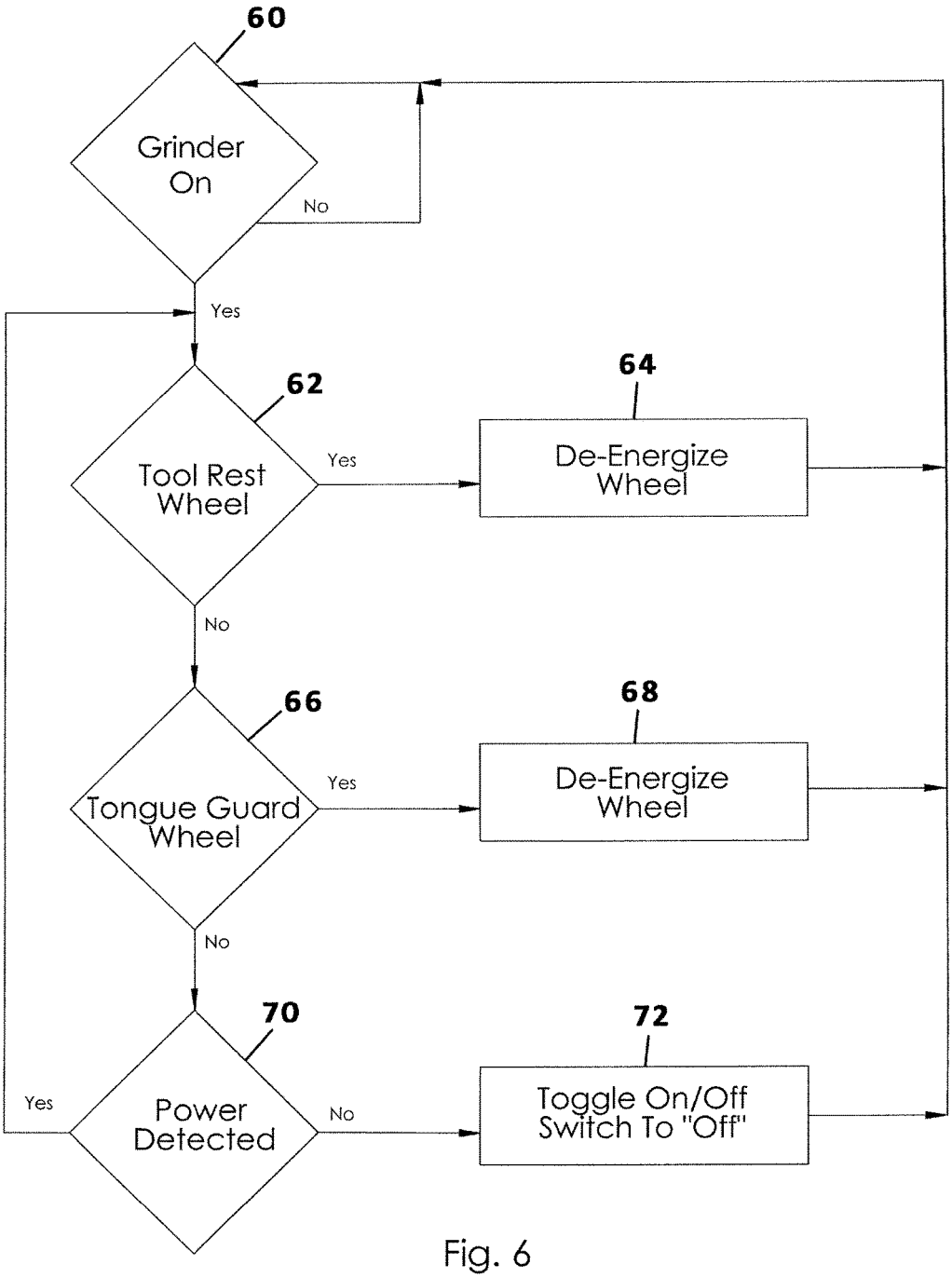
FIG. 6 is a flowchart illustrating the logic and operation of the safety and monitoring system.

In use, a bench grinder 100 may be retrofitted with the safety and monitoring system 10 described above. Then, the contactor wheel(s) may be activated and used in the normal manner to grind a work piece. FIG. 6 illustrates an exemplary process of operation of the safety and monitoring system 10. At step 60, the controller 30 determines if the grinder is activated and, if so continues to steps 62 and 64. As the front contactor surface 114 becomes worn down, the gap between the tool rest 120 or tongue guard 126 and the front contactor surface 114 becomes larger. When that gap is larger than a predetermined distance, the controller 30 in communication with a respective optical sensor or ranging sensor will, at steps 64 and 68 respectively, de-energize the motor 110 and contactor wheel 112 of the bench grinder 100. In addition, if the bench grinder 100 loses power, as determined at step 70, the safety and monitoring system 10 will toggle the activation member 44 to "off" at step 72 and will disallow the motor 110 to be re-energized when power is restored until a proactive actuation of an activation member 44 is pressed by a user.

It is understood that while certain forms of this invention have been illustrated and described, it is not limited thereto except insofar as such limitations are included in the following claims and allowable functional equivalents thereof.

The invention claimed is:

1. A bench grinder safety and monitoring system for maintaining worker safety while using a bench grinder having a motor operatively coupled to a contactor wheel, a tool rest in lower proximity to the contactor wheel that defines a tool rest gap between the tool rest and contactor wheel and having a tongue guard in upper proximity to the contactor wheel that defines a tongue guard gap between the tongue guard and the contactor wheel, said grinder safety and monitoring system, comprising:

a first optical sensor situated within in the tool rest gap having an emitter portion coupled to the tool rest adjacent a first side of the contactor wheel and a receiver portion coupled to the tool rest adjacent a second side of the contactor wheel, said emitter portion configured to project a beam of light across the tool rest gap toward said receiver portion;

a controller electrically connected to the motor of the bench grinder and in data communication with said receiver portion of said first optical sensor, said controller configured to determine if said light beam is received by said receiver portion and, if so, to de-energize the motor; and a second optical sensor situated within in the tongue guard gap having an emitter portion coupled to the tool rest adjacent said first side of the contactor wheel and a receiver portion coupled to the tongue guard adjacent said second side of the contactor wheel, said emitter portion configured to project a beam of light across the tongue guard gap toward said receiver portion;

wherein said controller is in data communication with said receiver portion of said second optical sensor and configured to determine if said light beam is received by said receiver portion and, if so, to de-energize the motor.

2. The bench grinder safety and monitoring system as in claim 1, further comprising a digital display in data communication with said controller and configured to publish sensor data relative to said first and second optical sensors.

3. The bench grinder safety and monitoring system as in claim 2, wherein said sensor data includes a status indicative if respective light beams of said first and second optic sensors is received or broken.

4. The bench grinder safety and monitoring system as in claim 2, wherein said digital display includes a touch screen input member.

5. The bench grinder safety and monitoring system as in claim 1, further comprising an activation member electrically connected to said controller and configured to energize or de-energize the motor when actuated, respectively.

6. The bench grinder safety and monitoring system as in claim 5, wherein said controller is configured to prevent electrical activation of the motor following a loss and then restoration of electrical power until a positive actuation of said activation member.

7. The bench grinder safety and monitoring system as in claim 1, further comprising:

a first ranging sensor coupled to said tool rest and configured to project/reflect a light beam directly toward a front contactor surface of the contactor wheel and to receive a reflected beam indicative of a distance between said tool rest and the contactor wheel;

wherein said controller is electrically connected to the motor and in data communication with said first ranging sensor, said controller configured to determine if said distance indicated by said reflected beam is less than a predetermined distance and, if so, to de-energize the motor.

8. The bench grinder safety and monitoring system as in claim 7, further comprising:

a second ranging sensor coupled to said tongue guard and configured to project/reflect a light beam directly toward said front contactor surface of the contactor wheel and to receive a reflected beam indicative of a distance between said tongue guard and the contactor wheel;

wherein said controller is electrically connected to the motor and in data communication with said second ranging sensor, said controller configured to determine if said distance indicated by said reflected beam is less than a predetermined distance and, if so, to de-energize the motor.

9. The bench grinder safety and monitoring system as in claim 8, further comprising a digital display in data communication with said controller and configured to publish sensor data relative to said first and second ranging sensors.

10. The bench grinder safety and monitoring system as in claim 9, wherein said sensor data includes a measured distance between said tool rest and said front contactor surface and said predetermined distance.

11. The bench grinder safety and monitoring system as in claim 10, wherein said digital display includes a touch screen input member configured to receive a user selection of said predetermined distance.

12. The bench grinder safety and monitoring system as in claim 7, further comprising an activation member electrically connected to said controller and configured to energize or de-energize the motor when actuated, respectively.

13. The bench grinder safety and monitoring system as in claim 5, wherein said controller is configured to prevent electrical activation of the motor following a loss and then restoration of electrical power until a positive actuation of said activation member.

14. A bench grinder safety and monitoring system for maintaining worker safety while using a bench grinder of a type having a motor operatively coupled to a pair of spaced apart contactor wheels that rotate in respective vertical planes when energized, a pair tool rests in lower proximity to respective contactor wheels that defines tool rest gaps between respective tool rests and respective contactor wheels, and having a pair of tongue guards in upper proximity to respective contactor wheels that defines tongue guard gaps between respective tongue guards and respective contact wheels, said grinder safety and monitoring system, comprising:

a first optical sensor situated within the tool rest gap associated with a first contactor wheel of the pair of contactor wheels, said first optical sensor having an emitter portion coupled to the respective tool rest adjacent a first side of the first contactor wheel and a receiver portion coupled to the respective tool rest adjacent a second side of the first contactor wheel, said emitter portion configured to project a beam of light across the tool rest gap toward said receiver portion;

a controller electrically connected to the motor of the bench grinder and in data communication with said receiver portion of said first optical sensor, said controller configured to determine if said light beam is received by said receiver portion and, if so, to de-energize the motor; and a first ranging sensor situated within the tool rest gap associated with a second contactor wheel of the pair of contactor wheels and configured to project/reflect a light beam directly toward a front contactor surface of the second contactor wheel and to receive a reflected beam indicative of a distance between the tool rest and the second contactor wheel;

wherein said controller is in data communication with said first ranging sensor, said controller configured to determine if said distance indicated by said reflected beam is less than a predetermined distance and, if so, to de-energize the motor.

15. The bench grinder safety and monitoring system as in claim 14, comprising:

a second optical sensor situated within the tongue guard gap associated with the first contactor wheel of the pair of contactor wheels, said second optical sensor having an emitter portion coupled to the respective tool rest adjacent a first side of the first contactor wheel and a receiver portion coupled to the respective tool rest adjacent a second side of the first contactor wheel, said emitter portion configured to project a beam of light across the tongue guard gap toward said receiver portion;

wherein said controller is in data communication with said receiver portion of said second optical sensor, said controller configured to determine if said light beam is received by said receiver portion and, if so, to de-energize the motor;

a second ranging sensor situated within the tool guard gap associated with the second contactor wheel of the pair of contactor wheels and configured to project/reflect a light beam directly toward a front contactor surface of the second contactor wheel and to receive a reflected beam indicative of a distance between the tool guard and the second contactor wheel; and wherein said controller is in data communication with said second ranging sensor, said controller configured to determine if said distance indicated by said reflected beam is less than a predetermined distance and, if so, to de-energize the motor.

16. The bench grinder safety and monitoring system as in claim 14, further comprising a digital display in data communication with said controller and configured to publish sensor data relative to said first and second optical sensors.

17. The bench grinder safety and monitoring system as in claim 16, wherein said sensor data includes a status indicative if respective light beams of said first and second optical sensors is received or broken.

18. The bench grinder safety and monitoring system as in claim 14, further comprising an activation member electrically connected to said controller and configured to energize or de-energize the motor when actuated, respectively.

19. The bench grinder safety and monitoring system as in claim 15, wherein said controller is configured to prevent electrical activation of the motor following a loss and then restoration of electrical power until a positive actuation of said activation member.

20. The bench grinder safety and monitoring system as in claim 16, wherein said sensor data includes a measured distance between said tool rest and said front contactor surface and said predetermined distance.

21. The bench grinder safety and monitoring system as in claim 16, wherein said digital display includes a touch screen input member configured to receive a user selection of said predetermined distance.

* * * * *